United States Patent [19]

Watterson

[11] Patent Number: 4,750,736

[45] Date of Patent: Jun. 14, 1988

[54] MULTIPURPOSE EXERCISE MACHINE

[75] Inventor: Scott R. Watterson, River Heights, Utah

[73] Assignee: Weslo, Inc., Logan, Utah

[21] Appl. No.: 859,613

[22] Filed: May 5, 1986

[51] Int. Cl.[4] ..... A63B 21/00; A63B 69/06

[52] U.S. Cl. ..... 272/72; 272/144

[58] Field of Search ..... 272/72, 130, 134, 144, 272/73

[56] References Cited

U.S. PATENT DOCUMENTS

| | | | |
|---|---|---|---|
| D. 263,978 | 4/1982 | Brentham . | |
| 2,209,034 | 7/1940 | Paul | 272/72 |
| 2,855,200 | 10/1958 | Blickman | 272/72 |
| 4,140,312 | 2/1979 | Buchmann | 272/73 |
| 4,240,627 | 12/1980 | Brentham | 272/130 |
| 4,316,609 | 2/1982 | Silberman | 272/118 |
| 4,319,747 | 3/1982 | Rogers | 272/73 |
| 4,477,071 | 10/1984 | Brown et al. | 272/72 |
| 4,595,194 | 6/1986 | Previtali | 272/73 |
| 4,611,807 | 9/1986 | Castillo | 272/73 |
| 4,637,608 | 1/1987 | Owens et al. | 272/134 |

OTHER PUBLICATIONS

Ajay Octagym Exercise Instruction Booklet, Japan Utility Model Publication 51-10842.

Weslo "Body Shop 360" Brochure, Weslo Int. Inc., P.O. Box 10, Logan, UT 84321.

*Primary Examiner*—Richard J. Apley

*Assistant Examiner*—S. R. Crow

*Attorney, Agent, or Firm*—Trask, Britt & Rossa

[57] ABSTRACT

Rowing machine structure with resistance may be reoriented to be upright. Bench structure is attached to the upright rowing structure so that the user positioned on the bench structure may operate the resistance structure in the performance of exercises such as leg-raise exercises.

19 Claims, 3 Drawing Sheets

MULTIPURPOSE EXERCISE MACHINE

BACKGROUND OF THE INVENTION

1. Field:

This invention relates to exercise equipment, and more particularly, multipurpose home exercise equipment of the type which can be repositioned between multiple orientations.

2. State of the Art:

A variety of exercise machines have been devised for use in the home or by individual users in the home environment. Some of these machines are useful for performing one type of exercise or a very limited number of exercises. For example, rowing machines are widely available and may be used for performing rowing-type exercises as well as certain curl-type exercises, sit-up exercises and the like.

A number of home exercise machines may be regarded as multipurpose exercise machines. That is, they may be converted or reoriented in a variety of different ways so that a user may perform a broader range or spectrum of exercises and, with the addition of certain additional attachments, may be used for the performance of yet additional exercises. Examples of these machines include the Body Tone 300 exercise machine and the GYMPAC machines which are manufactured by Diversified Products Corporation of Opelika, Ala. Also, the Body Shop 360 exercise machine with and without butterfly attachment is one of these machines. It is manufactured by Weslo, Inc. of Logan, Utah. The OCTOGYM machine manufactured by AJAY of Dulevan, Wis., is also one of these machines.

The machines presently available, including the ones noted hereinbefore, are either quite complicated, such as the AJAY OCTOGYM machine, or have limited versatility, such as the Body Tone 300 machines and Body Shop 360 machines. A more versatile arrangement is therefore desirable.

SUMMARY OF THE INVENTION

A multipurpose exercise machine includes rowing machine structure for performing rowing exercises in a rowing orientation. The rowing machine structure includes a frame with resistance structure for manipulation by the user in performing the rowing exercises. Support means is associated with the rowing machine structure to support the rowing machine structure in a second orientation with the frame positioned essentially upright. A bench structure is adapted to the rowing machine structure and positioned relative to the resistance means for the performance of additional exercises.

In a preferred embodiment, the rowing machine structure includes a track upon which the rowing seat is slidably adapted. The rowing machine structure has a frame which includes a frame extension which extends telescopically rearward therefrom. In the preferred embodiment, the rowing machine frame extension member and the track are removable and reassembled into a first member which is adapted to the rowing structure. The extension member is adapted to the first member to act as a leg. A user support is thereupon mounted onto the first member so that the user may reside thereupon and manipulate the resistance means for the performance of additional exercises, such as leg elevation exercises.

DESCRIPTION OF THE ILLUSTRATED EMBODIMENTS

Figure 1:
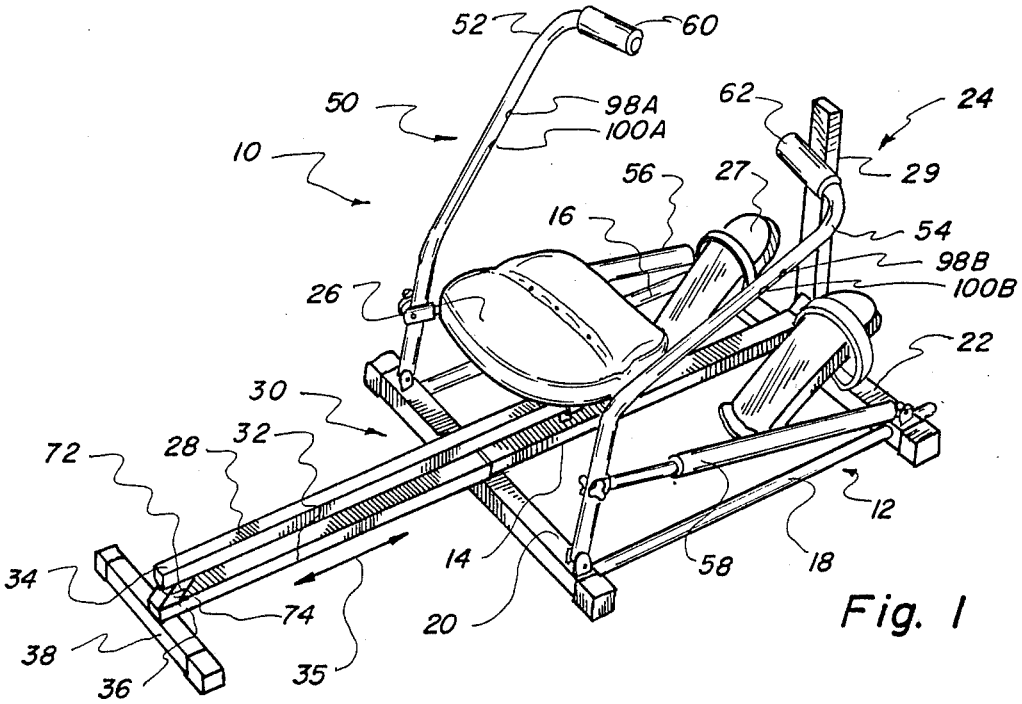
FIG. 1 is a perspective view of the rowing machine structure of the instant invention positioned in a rowing machine orientation.

The multipurpose exercise machine of the instant invention includes rowing machine structure generally illustrated in FIG. 1 and generally denominated with the numeral 10. The structure 10 illustrated in FIG. 1 is quite similar in assembly and function to the Body Shop 360 exercise machine available from Weslo, Inc., P.0. Box 10, Logan, Utah. Of course, the machine of the instant invention and as hereinafter described and illustrated differs from the Body Shop 360 machine, as will be apparent to those skilled in the art from the description hereinafter set forth.

Referring specifically to FIG. 1, it can be seen that the rowing machine structure therein illustrated includes a frame, generally depicted by the numeral 12. The frame 12 which constitutes frame means includes a central frame member 14 and a pair of outside frame supports 16 and 18. Transverse spars 20 and 22 are adapted to the central frame member 14 and also are interconnected by the outside frame support 16 and 18. The frame 12 is oriented to have a front end, generally denominated with the numeral 24. The front end, as can be here seen, is the end to which the user would face when performing rowing exercises while residing on seat 26, which is slidably adapted to track 28, which is mounted to the center frame member 14.

Foot supports 27 are adapted to the rowing structure 10 at the front end 24 for use in the performance of rowing exercises and other exercises such as sit ups. The foot supports 27 may be sized and positioned to angulate away from, for example spar 22, so that the foot supports 27 act as part of the support structure to support the rowing machine structure 10 when it is reoriented to the upright position as hereinafter discussed.

A post 29 is adapted to the frame 12 at the front end 24 by mounting it to the central frame member 14. Upon tipping or rotation of the rowing machine structure shown in FIG. 1 from the rowing orientation depicted in FIG. 1 to an upright or second orientation shown in FIG. 2, the post 29 may provide some support for the structure 10 when positioned in the second orientation. That is, the post 29 may act as a leg or foot to provide stability for the structure as hereinafter discussed.

The rowing machine structure 10 is supported in the upright configuration by support means. As here illustrated the support means includes extensions 110 and 112 (FIG. 2) of members 16 and 18. It may also include the post 29. Alternately the support means may include the foot supports 27.

The frame 12 of the rowing machine structure 10 depicted in FIG. 1 also has a rear end, generally denominated with the numeral 30. An extension member 32 is sized to telescopically slide into and out of the central frame member 14. The track 28 is moveably adapted to the central frame member 14 by appropriate means, such as the yoke 33 illustrated, so that it may slide relative thereto. The distal end 34 of the track is mounted to the extension member 32, as better seen in FIG. 4. With the track 28 mounted to the extension member 32, it can be seen that the extension member 32 and track 28 can be moved together to provide a length adjustment 35 in order to provide an extended track run for users of different sizes. It should be noted that the distal end 36 of the extension member 32 has a transverse spar 38 affixed thereto for support.

It can be seen that the rowing machine structure 10 of FIG. 1 is positioned in what those skilled in the art would recognize as a rowing orientation. It is preferably placed on a horizontal surface or a surface that is substantially horizontal. That is, most floors or similar support surfaces upon which the machine 10 is to be positioned for the performance of rowing exercises will be regarded as horizontal. However, some users may wish to position the machine in the rowing orientation on a surface that is inclined to the horizontal in order to modify the degree of difficulty or stress involved in the performance or certain exercises or to exercise different muscles. For example, users may wish to perform sit up type exercises with the machine in the rowing orientation and inclined at the front end 24. That is, the structure 10 may be placed on an surface inclined up to about 30° from the horizontal, on either the front end 24 or the back end 30, as desired by the user.

Those skilled in the art will also recognize that legs or extensions of various types (not shown) may be adapted to the frame 12 proximate the spar 22 or proximate the spar 38 to elevate the rear end 30 or the front end 24, as desired, in the absence of an inclined surface. The elevation may be of such magnitude that the angle between a horizontal support surface (e.g., floor) and the essentially straight central member 14 may be even as much as 40° to 45°. The degree of elevation is limited by the ability of the user to practically perform exercises thereon. An elevation in excess of 30° is not generally regarded as desirable.

Figure 2:
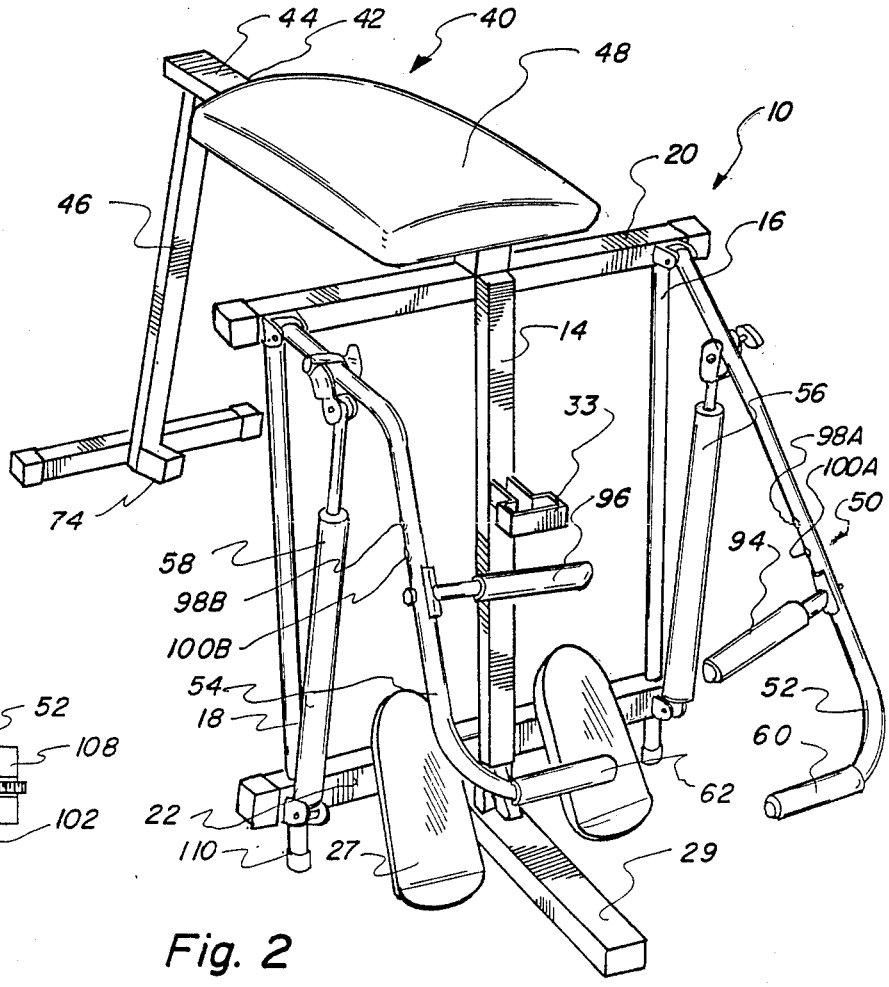
FIG. 2 is a perspective view of the rowing machine structure of the instant invention with the bench structure assembled and adapted thereto.

Referring now to FIG. 2, it can be seen that the rowing structure 10 has been reoriented from the rowing orientation depicted in FIG. 1 to an upright configuration. As here seen, the upright configuration is one in which the frame 12 is preferably normal to the support surface upon which the structure is placed. Of course, the support surface is typically a floor which is horizontal. Those skilled in the art will recognize that rowing machine structure 10 is preferably oriented to be 90° with respect to the support surface but may also be positioned in an angular relationship from the support surface or floor as much as 30° from the vertical and still be regarded as upright and useful for performing exercises as more fully discussed hereinafter.

As seen in FIG. 2, bench structure 40 is shown assembled to the rowing machine structure 10. The bench structure 40 includes a first member means 42, which is adapted at one end to the rear end 30 of the rowing machine structure 10. At its other end, or distal end 44, the first member means 42 has leg structure 46 adapted thereto for support. A bench support means 48 is positioned on the first member means 42. It can be seen that the bench support means 48 is positioned relative to the resistance structure 50 so that a user may reside upon the bench support means 48 and manipulate the resistance structure 50 for the performance of additional exercises.

The resistance structure 50, which is shown in both FIGS. 1 and 2, includes a pair of levers 52 and 54, which are rotatably mounted to the frame means 12 and, as here shown, to the spar 20. Appropriate resistance means, which are here shown to be a pair of hydraulic cylinders 56 and 58, are adjustably interconnected between the levers 52 and 54 and the frame means 12 to provide appropriate variable resistance to the movement of the levers 52 and 54 by the user. The levers 52 and 54 include appropriate handles 60 and 62 for grasping by the user. On FIG. 1 it can be seen that the resistance structure 50 is used for providing the resistance for performing rowing exercises. In the arrangement shown in FIG. 2, the same resistance structure 50 can be used for providing the resistance for the performance of exercises while the user resides upon the bench support means 48.

Figure 3:
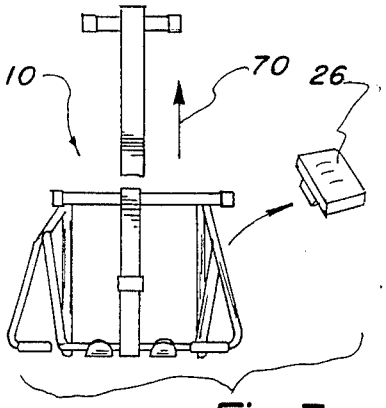
FIG. 3 is a perspective view of the rowing machine structure of FIG. 1 illustrating the removability of the track and extension member therefrom.

Referring now to FIGS. 3 through 6, it can be seen that the rowing machine structure 10 of FIG. 1 can be reconfigured into the arrangement shown in FIG. 2 by the process of assembly and disassembly, as illustrated in FIGS. 3 through 6. Referring in particular to FIG. 3, the rowing machine structure 10 is first preferably placed in an upright configuration. The track 28 and the extension member 32 are removed therefrom by lifting them upwardly, as illustrated, in the direction of arrow 70. At the same time the rowing seat 26 is removed therefrom. The user may place a foot on the post 24 or otherwise provide some amount of holding pressure to the frame 12 in order to facilitate easy disassembly of the track 28 and extension member 32 from the rowing structure 10.

Figure 4:
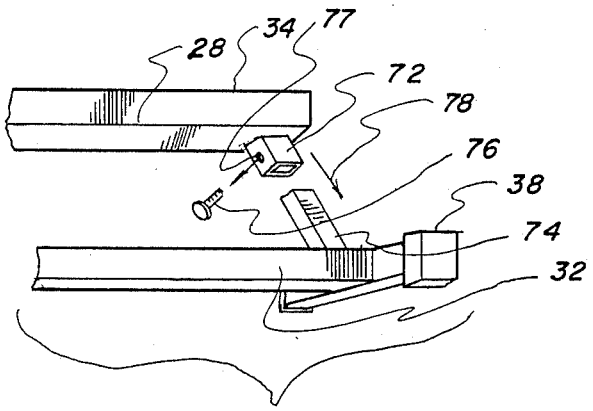
FIG. 4 is a partial view of the track and extension member showing the assembly relationship therebetween.

Referring now to FIG. 4, it can be seen that the track 28 and extension member 32 can be disassembled. In the assembled form, the track 28 has a short tubular member 72 affixed thereto to register with a corresponding tubular member 74 attached to the extension member 32. In the assembled form, the tubular member 72 slidably inserts either into or over the corresponding extension tubular member 74 and is affixed thereto by an appropriate bolt 76 positioned into a corresponding apeture 7. As illustrated in FIG. 4, the bolt 76 can be removed and the extension member 32 separated from the track 28, as indicated by the arrow 78.

Figure 5:
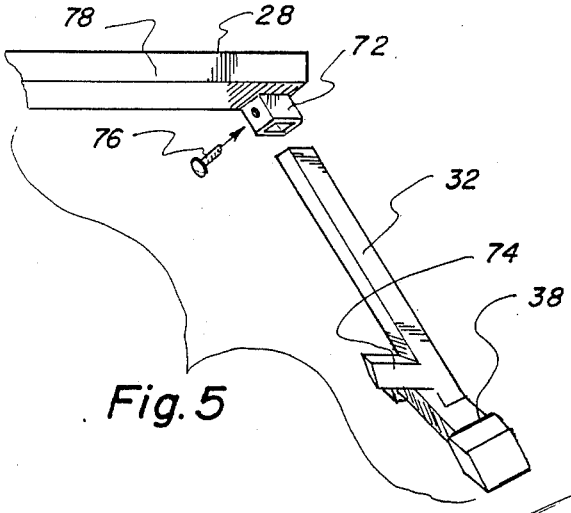
FIG. 5 is a partial view of the track and extension member arranged in the bench structure configuration.

As seen in FIG. 5, the track 28 and extension member 32 can be reassembled to be the first member means 42 and leg structure 46 of the bench structure 40, illustrated in FIG. 2. That is, the extension member 32 is a hollow tubular member here shown to be generally rectalinear in cross section. It is sized to either fit into or over the tubular extension 72 affixed to the underside 78 of the track 28. The bolt 76 can be reinserted in order to provide for a removable, but stable, assembly. It can be seen in FIG. 5 that the tubular extension 74 is preferably oriented toward the rowing machine structure. When assembled, as illustrated in FIG. 5 and as seen in FIG. 2, the spar 38 together with the tubular extension 74, provide a foot or base for providing stable support to the bench structure 40, when assembled and positioned as seen in FIG. 2.

Figure 6:
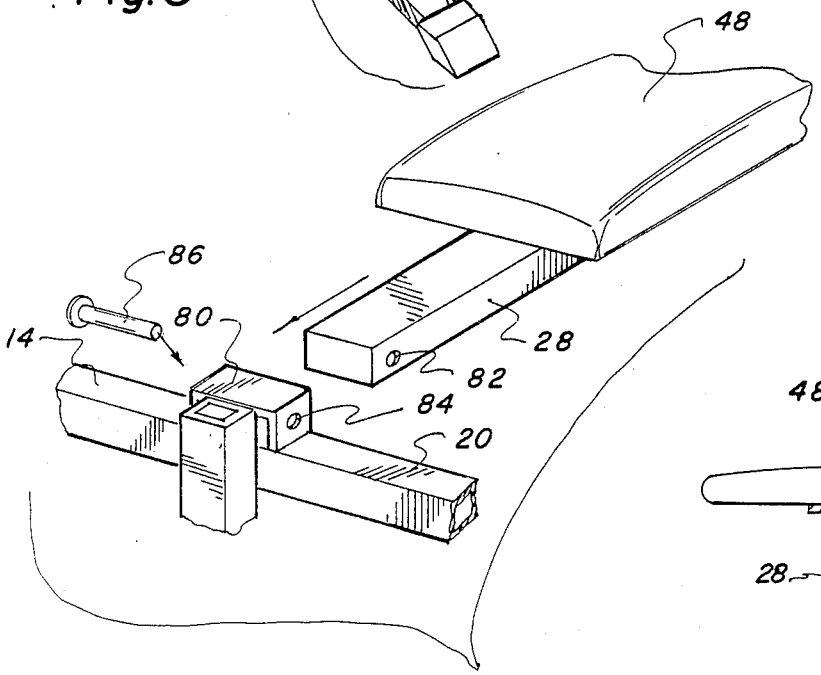
FIG. 6 is a partial view showing the assembly of the bench structure to the rowing machine structure.

As can be seen in FIG. 6, one end of the track 28 can be mounted to the rear end 30 of the rowing structure 10 when the structure 10 is oriented in the upright configuration shown in FIG. 2. An appropriately sized adaptor 80 is affixed to spar 20 immediately underneath central member 14. The track 28 is sized to fit within the adaptor 80 and is provided with appropriate apertures 82 and 84 so that an appropriate pin or nut and bolt arrangement 86 may be positioned to securely fasten the track 28 thereto. As so configured, the track 28 acts as the first member means 42 of the bench structure 40 upon which the bench support means 48 may be positioned as hereinbefore described.

The disassembly of the bench structure 40 may be effected by simply removing the pin or nut and bolt arrangement 86, removing the track 28 from the adaptor 80, disassembling and assembling as illustrated in FIGS. 3 through 5 to effect the configuration seen in FIG. 1.

Figure 7:
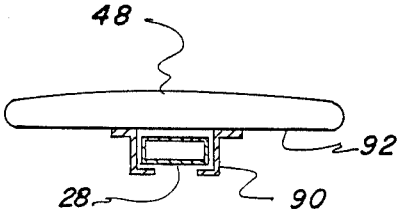
FIG. 7 is a cross sectional view of bench user support structure for use with the instant invention.

Referring to FIG. 7, it can be seen that the bench support means 48 has a channel structure 90 affixed to the underside 92 thereof. The channel structure 90 is sized and shaped to provide an easy sliding arrangement with, for example, the track 28. Thus, the bench user support 48 may be slid over the track 28 and positioned along the length of the track, as desired by the user in either the configuration of FIG. 1 or FIG. 2.

It should also be noted that the channel 90 of the bench support means 48 is sized to register with the post 29, shown in FIG. 1. Thus, the bench support means 48 may be slid onto and off of the post 29 for storage with the device in the orientation and configuration seen in FIG. 1. It may also be slid on and off the post 28 or adjusted along the length thereof for the performance of additional exercises with the rowing machine structure 10 positioned in the upright configuration, generally as seen in FIG. 2 with or without the bench structure assembled as seen in FIG. 2.

Figure 2A:
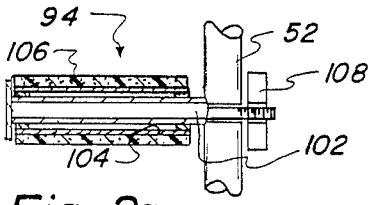
FIG. 2A is a cross sectional view of a bar member adapted to the lever of the resistance structure of the rowing machine structure of the instant invention.

Referring back to FIG. 2, foot bars 94 and 96 are adapted to respective levers 52 and 54 of the resistance means 50. The bars 94 and 96, which may also be viewed as handles, are affixed by any one of a selected series of apertures 98A, 98B and 100A, 100B formed along the length of the levers 52 and 54 to provide for individual adjustments of the bars to the user. The bars 94 and 96 may have soft foam or rubber-type material affixed thereto as a cushion for comfort. Bars 94 and 96 may optionally be assembled to rotate. That is, by referring to FIG. 2A, which is a cross section of an alternate embodiment of bar 94, it can be seen that the bar 94 is comprised of a main shaft or axle 102 with a cylinder 104 journaled thereto at its opposite ends. An appropriate cushion or rubber material 106 is affixed to the outside of the cylinder 104. The bar 94, in turn, is assembled to its appropriate lever, such as lever 52, by an appropriate wing nut or bolt arrangement 108.

Figure 8:
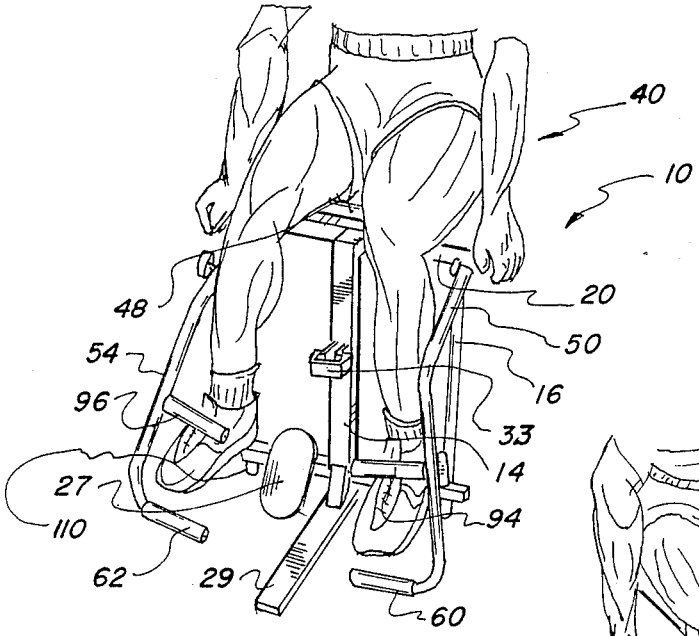
FIG. 8 is a partial view of the structure of FIG. 2 with the user positioned thereon for performing exercises.
Figure 9:
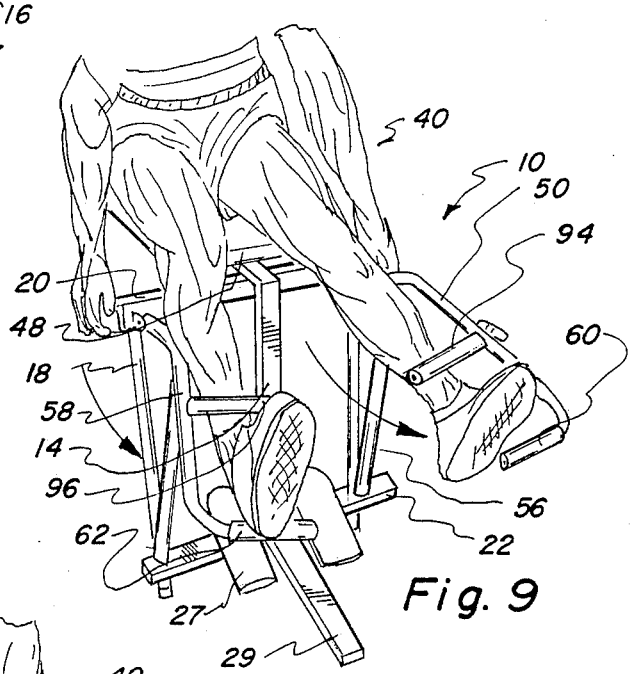
FIG. 9 is a partial view of the structure of FIG. 2 with the user positioned thereon for performing exercises.
Figure 10:
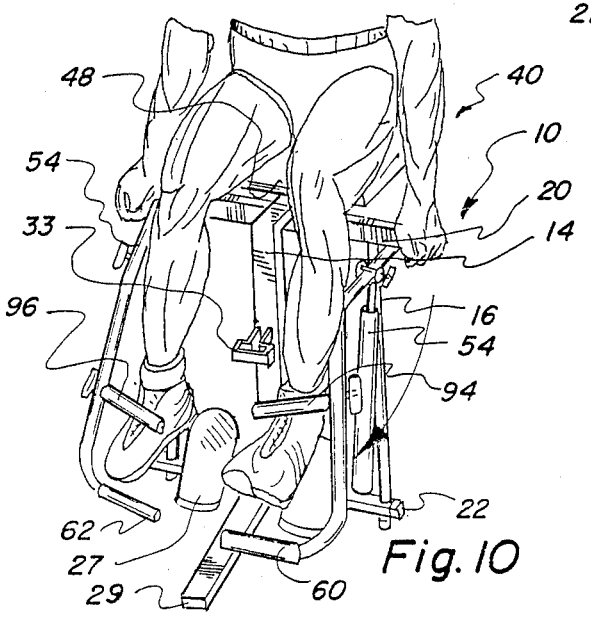
FIG. 10 is a partial view of the structure of FIG. 2 with the user positioned thereon for performing exercises.

Referring to FIGS. 8 through 10, it can be seen that the user may, for example, sit or lay upon the bench support means 48 with the device configured and assembled as shown in FIG. 2. Thereupon, the user may position his or her feet proximate the levers 52 and 54, and more particularly the bars 94 and 96, to perform leg-raise type exercises in unison or in an alternating mode as seen in FIGS. 9 and 10.

It should be recognized that the above-described embodiments illustrate the principals of the invention. It should be understood that the illustrated embodiment is not intended to limit the scope of the claims, which themselves recite those features which are critical to the invention.

I claim:

1. A multipurpose exercise machine comprising:

rowing machine structure for performing rowing exercises in a first orientation, said rowing machine structure including:

frame means with a front end and a rear end, an extension frame member removably attached to and extending from said rear end of said frame means in said first orientation;

track means reorientably associated with said frame means with a rowing seat removably slidably adapted thereto;

resistance structure including lever means for manipulation by the user in performing said rowing exercises; and support means associated with said rowing machine structure proximate said front end of said frame means to support said rowing machine structure in a second orientation wherein said frame means is positioned in said second orientation to be essentially upright;

wherein said extension frame member and said track means are removable from said first frame means to be reorientably coupled to each other to form a bench structure adaptable to said rowing machine structure to support a user when said rowing machine structure is positioned in said second orientation for performance of additional exercises, said bench structure including a bench user support positioned proximate said rear end of said frame means and relative to said resistance structure for manipulation of said resistance structure by a user positioned on said bench user support.

2. The multipurpose exercise machine of claim 1 wherein said bench structure includes:

a first member means adaptable to said rear end of said frame means to extend away therefrom;

leg structure adaptable to said first member proximate the distal end thereof to support said first member means; and wherein said bench user support is positioned on said first member means.

3. The multipurpose exercise machine of claim 2 wherein said lever means includes bar means removably adaptable thereto along the length there for interaction proximate the feet of a user when sitting on said bench user support.

4. The multipurpose exercise machine of claim 3 wherein said first member means is said track means.

5. The multipurpose exercise machine of claim 3 wherein said frame means of said rowing machine structure includes a central frame member and said extension frame member is adaptable to said central frame member to extend away therefrom, and wherein said leg structure is said extension frame member.

6. The multipurpose exercise machine of claim 5 wherein said extension frame member telescopes into and out of said central frame member.

7. The multipurpose exercise machine of claim 6 wherein said extension frame member has a transverse foot member adapted thereto proximate its distal end.

8. The multipurpose exercise machine of claim 3 wherein said support means includes a post adaptable to said frame means proximate said front end to extend substantially normal thereto.

9. The multipurpose exercise machine of claim 8 wherein said bench user support is positionable proximate said post along its length so that a user positioned thereon may manipulate said resistance structure when said rowing machine structure is in said second orientation.

10. The multipurpose exercise machine of claim 9 wherein said bench user support has means for slidably adapting it to said post.

11. The multipurpose exercise apparatus of claim 1 wherein said first connection means is comprised of interlocking tubular members.

12. A multipurpose exercise machine comprising:

rowing machine structure for performing rowing exercises in a rowing orientation, said rowing machine structure including:

a frame having a central member with a front end and a rear end having a transverse spar adapted to said central member proximate said rear end and having an extension member which telescopes in and out of said central member at said rear end, a track removably mounted to said frame with a rowing seat removably slidably adapted thereto, resistance structure including a pair of rowing levers with handles for manipulation by the user;

support means associated with said rowing machine structure proximate said front end of said frame means to support said rowing machine structure in a second orientation wherein said frame means is positioned in said second orientation to be essentially upright;

bench structure adaptable to said rowing machine structure to support a user when said rowing machine structure is positioned in said second orientation for performance of exercises, said bench structure including:

said track removed from said frame and removably adaptable at one end to said transverse spar, a leg member which is said extension member removed from said frame and adapted to said track at its distal end to extend there below to support said track, and a bench user support positioned on said track to support a user thereon.

13. The multipurpose exercise apparatus of claim 12 wherein in said bench structure, said track is coupled to said leg means by a first connection means adapted to said track and said leg member, and said track is coupled to said transverse spar by a second connection means adapted to said track and said transverse spar.

14. The multipurpose exercise apparatus of claim 13 wherein said first connection means is comprised of interlocking tubular members.

15. The multipurpose exercise apparatus of claim 13 wherein said second connection means is comprised of interlocking tubular members.

16. The multipurpose exercise apparatus of claim 14 wherein said second connection means is comprised of interlocking tubular members.

17. A multipurpose exercise machine comprising:

rowing machine structure for performing rowing exercises in a rowing orientation, said rowing structure including:

a frame having a front end and a rear end, an extension member removably coupled to and extending from the rear end of said frame, a track removably adapted to said frame with a rowing seat removably slidably adapted thereto, resistance structure including a pair of rowing levers for manipulation by a user;

first connection means adapted to said track and said extension member for reorientably coupling said track to said extension member to form a bench structure with a benchuser support positioned thereon; and second connection means adapted to said bench support and said frame for reorientably coupling said bench structure to said frame at said rear end with said frame in an upright orientation.

18. The multipurpose exercise apparatus of claim 12 wherein said second connection means is comprised of interlocking tubular members.

19. The multipurpose exercise apparatus of claim 12 wherein said first connection means and said second connection means are comprised respectively of interlocking tubular members.

* * * * *